United States Patent [19]

Rowley

[11] 3,945,601

[45] Mar. 23, 1976

[54] KNOCK-DOWN REUSABLE COLUMN FORM

[76] Inventor: Edward C. Rowley, 1725 Hallam Drive, Lakeland, Fla. 33803

[22] Filed: Oct. 24, 1974

[21] Appl. No.: 517,784

Related U.S. Application Data

[63] Continuation-in-part of Ser. No. 344,290, March 23, 1973, abandoned.

[52] U.S. Cl. ..... 249/48; 249/163; 249/194

[51] Int. Cl.[2] ..... E04G 13/02

[58] Field of Search ..... 249/48–49, 249/163, 168–169, 194, 219 R

[56] References Cited

UNITED STATES PATENTS

| | | | |
|---|---|---|---|
| 2,294,322 | 8/1942 | Van Der Woude | 249/194 |
| 3,063,111 | 11/1962 | Anthony | 249/202 |
| 3,260,493 | 7/1966 | Beckham | 249/194 |
| 3,373,047 | 3/1968 | Sheets et al. | 249/202 |
| 3,486,729 | 12/1969 | Schimmel | 249/189 |
| 3,854,692 | 12/1974 | Milton et al. | 249/194 |

*Primary Examiner*—Francis S. Husar
*Assistant Examiner*—John McQuade
*Attorney, Agent, or Firm*—B. P. Fishburne, Jr.

[57] ABSTRACT

A concrete construction form embodies separable panels each equipped with attached longitudinal metal frame members and plural transverse braces. Four identical panels with the attached metal components are assembled to form a self-squaring column form which is reusable indefinitely after separation of the panels. The form is secured in the assembled state by a plurality of easily detachable spring steel assembly clips applied to the transverse braces at the four corners of the form. Strength, tightness and a reduction of labor are prime features.

2 Claims, 5 Drawing Figures

KNOCK-DOWN REUSABLE COLUMN FORM

CROSS-REFERENCE TO RELATED APPLICATION

This application is a continuation-in-part of prior copending application Ser. No. 344,290, filed Mar. 23, 1973, now abandoned.

BACKGROUND OF THE INVENTION

A need has long existed in the concrete construction industry for a practical, efficient and convenient column or beam form which is reusable and economical to manufacture and laborsaving.

The prior art has contained some proposals to satisfy this need, and a typical example of the patented prior art is U.S. Pat. No. 3,107,087 issued to C. I. Williams on Oct. 15, 1963. In general, known or proposed devices for this purpose have not been adopted to any significant degree commercially for the simple reason that none has proven to be sufficiently convenient and fool-proof to use particularly by unskilled construction workers, and hence the need for a satisfactory knock-down reusable column or beam form has not been satisfied.

Accordingly, it is the objective of this invention to totally satisfy the above need of the art through the provision of a separable and reusable concrete construction form which is economical to manufacture, extremely durable and long-lasting, easy to assemble by unskilled labor and, in this sense, substantially fool-proof since it cannot be assembled improperly. Among the important features and advantages of the invention over the prior art are the self-squaring ability of the assembled form, its resistance to grout leakage at the corners due to a tight and uniform fit of the components and a superior resistance to bulging or buckling under heavy fluid-induced internal pressure. It is realistically estimated that the customary time involved in the construction of conventional forms on the job site can be reduced by fifty per cent. A great deal of plywood and other material waste is eliminated by the reusable nature of the form. The components of the invention are lightweight and strong and the panels are easily carried and set up in single, double or triple side combinations.

Other features and advantages of the invention will become apparent during the course of the following description.

BRIEF DESCRIPTION OF DRAWING FIGURES

DETAILED DESCRIPTION

Figure 1:
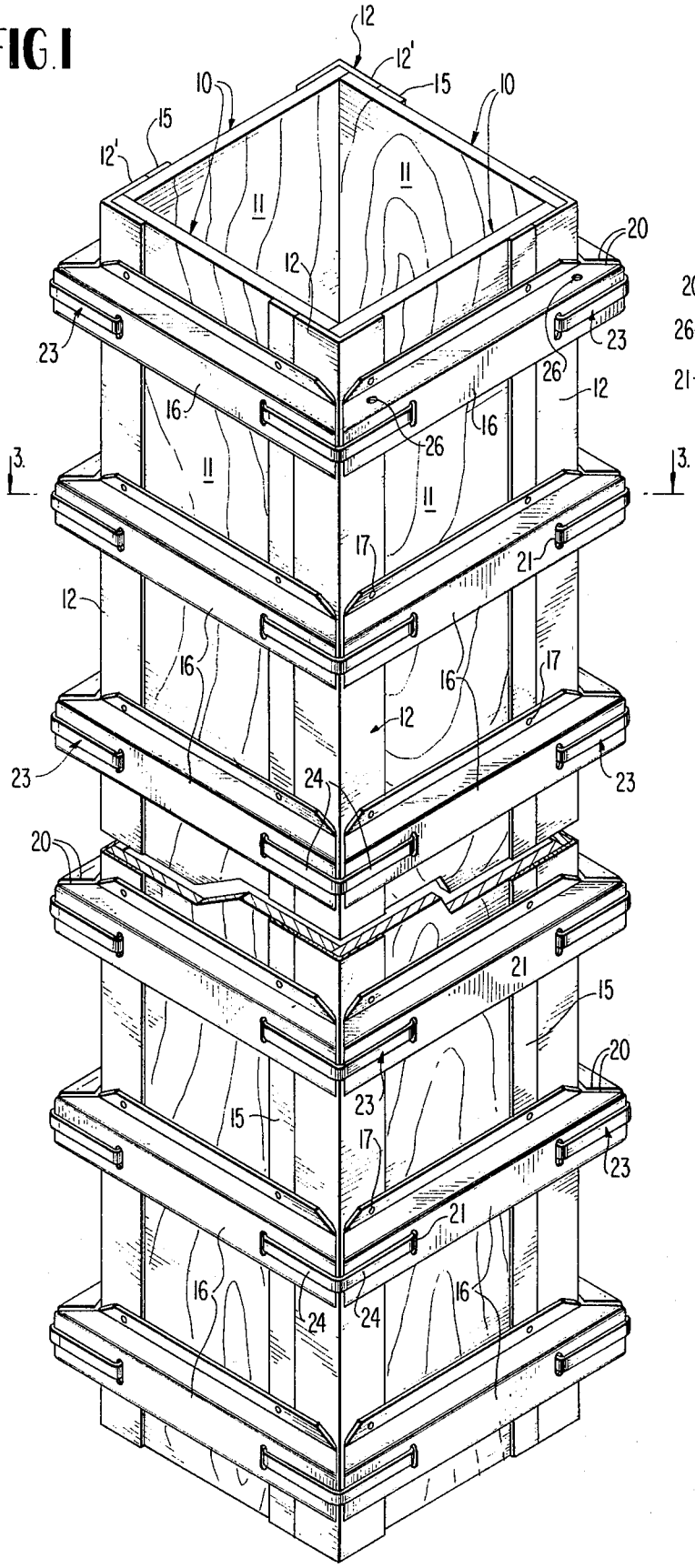
FIG. 1 is a fragmentary perspective view of a knock-down reusable concrete column form embodying the invention.

Referring to the drawings in detail wherein like numerals designate like parts throughout, the numeral 10 designates one of four identical panel sub-assemblies embodied in the assembled form depicted in FIG. 1.

Since the panel sub-assemblies are identical a detailed description of one will suffice to describe them all.

Each panel sub-assembly 10 comprises an elongated rectangular plywood body portion 11 preferably formed from commercial 7-ply exterior plywood or equivalent material. Conveniently, the panel sub-assemblies 10 can be constructed in 6 and 8 foot lengths so that joints between longitudinal sections of the form can be staggered around the four sides of the rectangular cross-section assembly. Other panel lengths may be utilized to meet particular needs.

Figure 2:
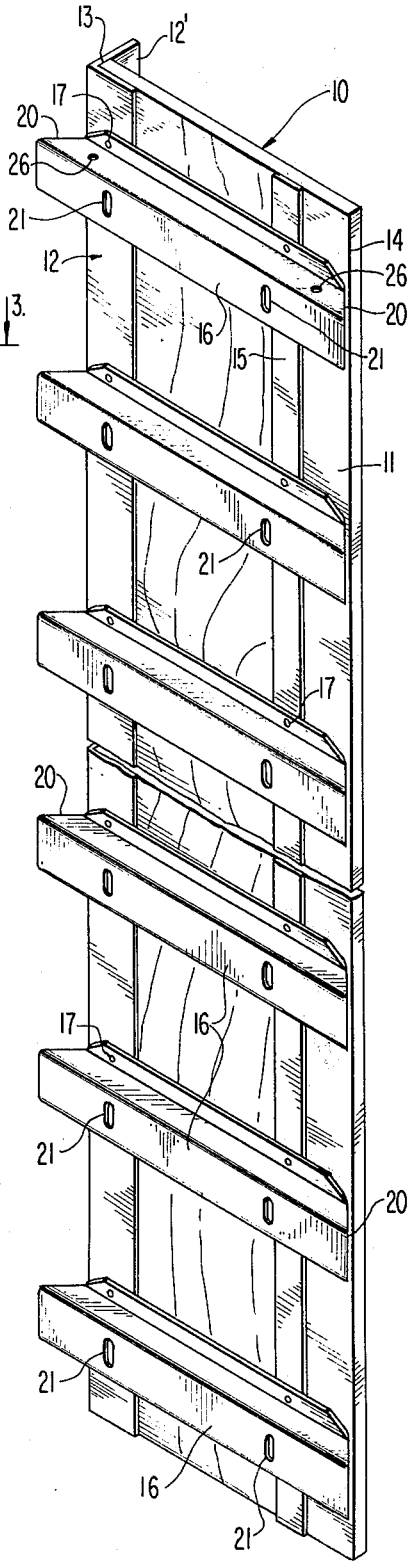
FIG. 2 is a perspective view of one typical side panel and attached metal parts embodied in the form.

Each plywood panel body portion 11 has rigidly attached to it by riveting or similar fastening means, not shown, a single sturdy 90° metal angle bar 12 which extends continuously along one longitudinal edge of the body portion 11 from end-to-end thereof. One of the two equal width webs of the angle bar 12 lies against the outer face of plywood body portion 11 and the other right angular web abuts the adjacent edge 13 of the plywood as depicted in FIG. 2. This latter angle bar web designated 12' in FIG. 2 projects considerably inwardly of the body portion 11 at right angles thereto.

Somewhat inwardly of and parallel to the opposite exposed longitudinal edge 14 of the plywood body portion 11 a continuous flat longitudinal metal frame bar 15 extends for the full length of the sub-assembly and is fixedly secured to the plywood by riveting or equivalent fastener means, not shown. The bars 12 and 15 are also parallel as well as coextensive lengthwise.

Figures 3, 4, 5:
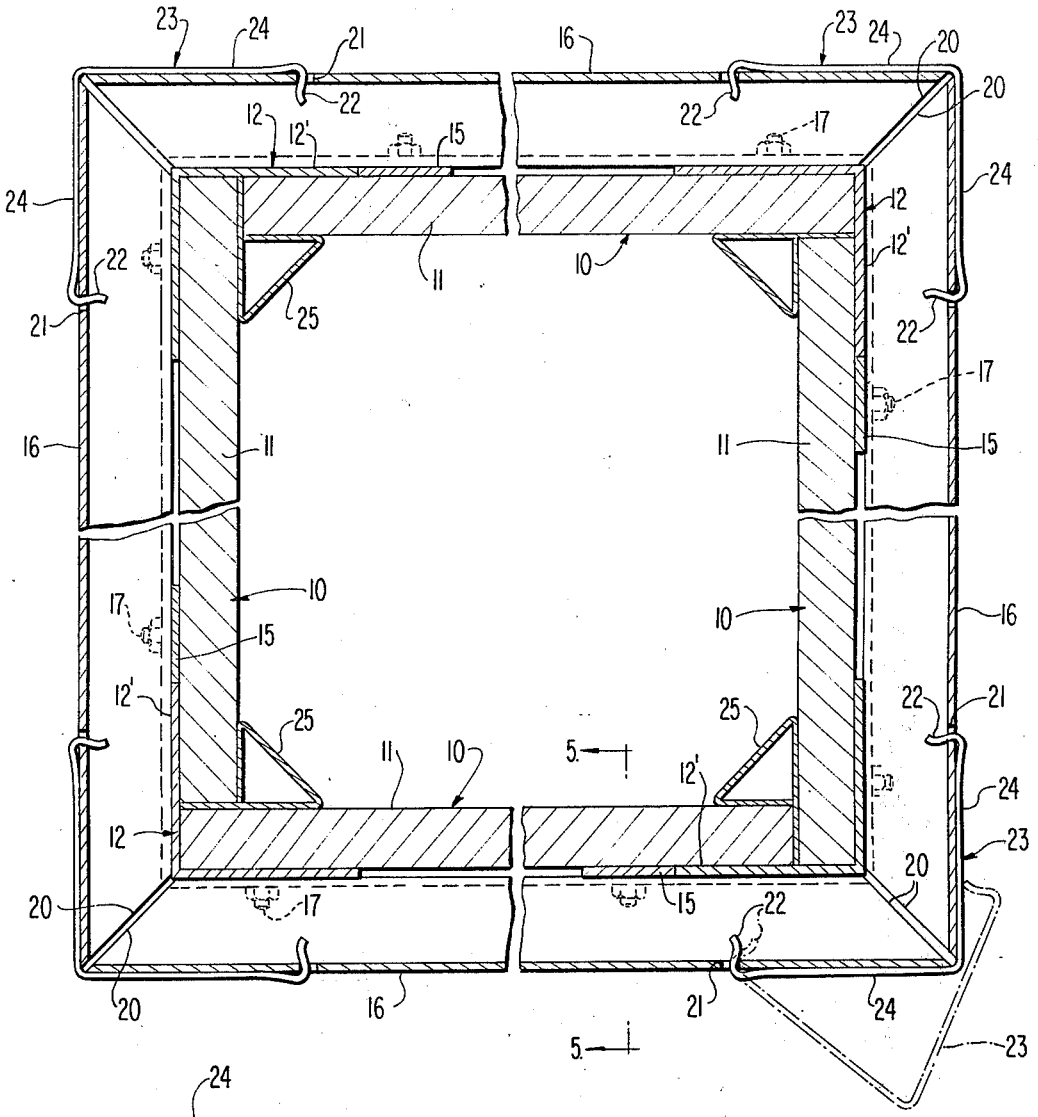
FIG. 3 is an enlarged typical horizontal cross section through the assembled form in the plane of transverse braces and assembly clips, taken on line 3—3 of FIG. 1.
FIG. 4 is a perspective view of a spring steel assembly clip.
FIG. 5 is a fragmentary vertical section taken on line 5—5 of FIG. 3.

At regular intervals along each panel sub-assembly 10, such as one foot intervals, plural identical transverse hat braces 16 are fixedly secured to the underlying bars 12 and 15 by suitable bolts 17 whose heads are recessed into the inner faces of the plywood panel body portions 11 as indicated at 18 in FIG. 5. These bolts pass through the wooden panels and through the adjacent portions of bars 12 and 15 and also through the opposite side flat flanges 19 of the transverse hat cross-section braces 16, as best shown in FIG. 5. It may be seen that the plural transverse braces 16 which are very rigid structurally tie together the metal bars 12 and 15 at a plurality of points along each form sub-assembly 10. Collectively, these attached metal parts render each panel sub-assembly very rigid and stable and highly resistant to bulging, springing or other deformation under wet concrete pressure loading.

As shown in the drawings, the opposite ends of the transverse braces 16 are beveled or mitered as at 20 to enable the complete assembling of the square cross-section form, as shown in FIG. 1. These mitered end portions 20 project beyond the longitudinal edges 13 and 14 of each panel body portion 11 as is readily apparent in FIG. 3, so that the mitered corners of the four braces 16 at each level on the assembled form project outwardly of the corners formed by metal angle bars 12.

Additionally, each brace 16 on sub-assembly 10 is provided near and equidistantly from its opposite ends and in its outer wall with a pair of slots 21 adapted to receive releasably the inturned terminals 22 of generally L-shaped tempered spring steel assembly clips 23, each clip having a pair of equal length arms 24, see FIG. 4. FIG. 4 shows one of the spring clips 23 in a free or relaxed state wherein the clip is tensioned to hold the arms 24 at an angle of less than 90°. When the clips 23 are applied to the corners of the form during the assembly process as illustrated in broken lines at the lower right hand corner of FIG. 3, each clip will be sprung or tensioned to a right angular shape so that it will tend to snugly embrace the square corner formed by the mitered ends 20 of the adjacent braces 16. Also, as best shown in FIG. 3, the curved terminals 22 of the clips are readily snapped into interlocking engagement with the braces 16 through the slots 21 by slight tapping with a hammer or screwdriver handle. The clips can be readily separated from the assembly when knocking it down by a screwdriver blade. In assembly, the terminals 22 are enclosed inside of the hollow braces 16 to produce a smooth exterior corner as clearly illustrated in FIG. 1. The collective holding power of the numerous spring clips 23 on the assembled form is tremendous so that the form is fully capable of resisting any and all bursting pressures to which it will ever be subjected in practice.

In view of the foregoing structural description of the invention, the manner of assembling and disassembling the form shown in FIG. 1 should be fairly clear. However, the following summary may be given. To start the assembly, a pair of the panel sub-assemblies 10 may be erected to form one square corner of the form. A significant feature of this invention is that the form is self-squaring with a high degree of accuracy as it is assembled. No problem arises in connection with properly pairing the sub-assemblies 10 as they are all identical with no "lefts" or "rights". In assembling one corner of a form, the projecting angle bar web 12' of one sub-assembly 10 is slipped under the end portions of braces 16 of another sub-assembly 10, which end portions are projecting beyond the flat bar 15 of the secondnamed sub-assembly. As shown clearly in FIG. 3, there is a space or slot formed between the end portion of each brace 16 beyond the flat bar 15 and the underlying plywood panel body portion 11. This narrow slot extends continuously across each brace 16 throughout the sub-assembly 10 and the collective slots receive the web or flange 12' of the particular angle bar 12 snugly. When properly in place, the free edge of the web 12' will abut the adjacent longitudinal edge of the flat bar 15 on the other sub-assembly 10 making up the particular corner of the square cross-section form. When the parts are thus slipped into place, the spring clips 23 are applied in the already-described manner and the assembly procedure is completed in substantially the identical manner until the erection of the column form is complete and secure. In the completed assembly, FIG. 1, the exposed edges 14 of the four plywood panel body portions 11 will abut the interior faces of the adjacent plywood panels making up the corners of the form and there are no slots or cavities into which the plywood must be placed or forced during the assembly process. On the completed form, the four corners are completely metal clad to resist injury and the corners are truly square and sufficiently tight to prevent loss of grout and yet not excessively tight so as to resist easy disassembling of the form. At all four corners of the form, after assembly, the projecting edges of webs 12' abut or contact the opposing straight edges of the flat bars 15 as shown in FIG. 1. The corner clips 23 are outermost on the assembly for easy access. The placement of the braces 16 at regular intervals renders the assembled form extremely strong and resistant to bursting pressure. The entire assembling and disassembling process is very simple, requires no particular skill and is economical and labor-saving. Preferably, the lowermost group of braces 16 on the assembled form are no more than about six inches above the base or bottom of the form for maximum strength.

FIG. 3 shows the inclusion in the form assembly of conventional sheet metal chamfering corner elements 25. This is an optional feature of the invention which may be omitted in some cases. FIG. 1 shows the assembly without the elements 25 included.

The column form may be modified to produce a beam form by omitting one sub-assembly 10 and substituting therefor suitable cross bracing means at the open side of the form. Such means are omitted in the drawings, and except for this change, the basic construction of the form is the same in either case.

Another relatively minor feature which may be mentioned is the provision of through openings 26 near the ends of each brace 16 to receive elements of adjustable props or braces, not shown, which may be used to stabilize the erected form. This also is an optional feature and the openings 26 could be omitted and other forms of propping or bracing means to stabilize the upright form can be used.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A knock-down reusable concrete construction form comprising plural flat panel body portions of elongated rectangular form and substantially equal dimensions, a substantially ninety degree angle bar attached to one longitudinal edge of each panel body portion with one flange of the angle bar lapping the outer face of the panel body portion and the other flange of the angle bar lapping the adjacent longitudinal edge of the panel body portion and extending inwardly of the interior face thereof, a substantially flat bar attached to the outer face of the panel body portion in parallel spaced relation to the angle bar and spaced inwardly of the other longitudinal edge of the panel body portion, said angle and flat bars being substantially coextensive lengthwise with the panel body portion, plural substantially equidistantly spaced transverse brace members mounted on said one flange of the angle bar and the outer face of the flat bar and extending across the panel body portion and having mitered ends, said brace members being of channel cross section including opposite side longitudinal mounting flanges adjacent the open sides of the brace members and said mounting flanges lying on said one flange of the angle bar and the outer face of said flat bar, the open sides of said brace members facing said panel body portion, through bolt means common to said angle and flat bars and said brace members passing through said panel body portion, angle and flat bars and said mounting flanges and anchoring such elements firmly to said panel body portion, said brace members spaced from the panel body portion by an amount equal to the thickness of said one web of the angle bar and said flat bar, said brace members having a pair of transversely elongated slots formed therethrough and each of said slots spaced equidistantly from a respective one of each of said mitered ends and being substantially centered transversely of the brace members, and plural identical symmetrically formed generally right angular spring clips snugly embracing the corners of a rectangular cross section construction form constructed from four of said panel body portions and associated angle and flat bars and brace members, said clips having equal length arms terminating in substantially right angular inwardly projecting reversely curved terminals yieldingly interlocking with pairs of said slots in adjacent brace members at the corners of said form, the bights of said clips receiving the tips of the mitered ends of the brace members at the corners of the form and the equal length arms of the clip lying substantially flat against the exterior faces of the brace members at the corners of the form, said clip terminals substantially enclosed and protected in the interiors of the brace members.

2. The structure of claim 1, and said spring clips formed of spring steel flat strip stock having uniform width from end-to-end of the clip and said width slightly less than the length of said brace member slots, said slots and clips substantially centered transversely of the brace members on said form.

* * * * *